US012187484B2

(12) United States Patent
Knitter et al.

(10) Patent No.: US 12,187,484 B2
(45) Date of Patent: Jan. 7, 2025

(54) MULTI-COMPARTMENT TRAY

(71) Applicant: Winpak Portion Packaging, Inc., Sauk Village, IL (US)

(72) Inventors: Jerald William Knitter, Bourbonnais, IL (US); Timothy Leo Ridley, St. John, IN (US)

(73) Assignee: Winpak Portion Packaging, Inc., Sauk Village, IL (US)

( * ) Notice: Subject to any disclaimer, the term of this patent is extended or adjusted under 35 U.S.C. 154(b) by 0 days.

(21) Appl. No.: 17/116,256

(22) Filed: Dec. 9, 2020

(65) Prior Publication Data

US 2021/0188476 A1 Jun. 24, 2021

Related U.S. Application Data

(60) Provisional application No. 62/952,524, filed on Dec. 23, 2019.

(51) Int. Cl.
*B65D 1/36* (2006.01)

(52) U.S. Cl.
CPC ..... *B65D 1/36* (2013.01)

(58) Field of Classification Search
CPC .... B65D 75/527; B65D 75/34; B65D 75/585; B65D 75/5888; B65D 1/30; B65D 21/0206; B65D 21/0205; B65D 21/0208
USPC ..... 220/23.83, 575, 4.23, 23.4, 23.6, 23.8, 220/23.2, 500, 520, 657; 206/534.1, 539, 206/820
See application file for complete search history.

(56) References Cited

U.S. PATENT DOCUMENTS

| | | | | |
|---|---|---|---|---|
| 5,938,068 | A | 8/1999 | Atkins et al. | |
| D467,499 | S | 12/2002 | Garza et al. | |
| 2007/0194495 | A1* | 8/2007 | Henderson | B65D 1/30 264/319 |
| 2007/0228039 | A1* | 10/2007 | Tyberghein | B65D 1/30 220/23.4 |

(Continued)

FOREIGN PATENT DOCUMENTS

| | | | |
|---|---|---|---|
| EP | 1092344 | A2 | 4/2001 |
| EP | 1640278 | A1 | 3/2006 |

(Continued)

OTHER PUBLICATIONS

International Search Report and the Written Opinion of the International Searching Authority, International Patent Application No. PCT/US2020/065215, pp. 1-15, dated Mar. 1, 2021.

(Continued)

*Primary Examiner* — Robert Poon
(74) *Attorney, Agent, or Firm* — Bond, Schoeneck & King, PLLC

(57) ABSTRACT

Provided is a multi-compartment tray having at least two compartments that are connected at the time of sale and then able to be split into separate, detached compartments by a user. The compartments are conjoined by a 3-dimensional wave-shaped perforation region. Each perforation wave includes a crest and a trough and perforation tabs are formed on at least some of the crests and troughs and form the point of interconnection between the compartments. In use, a user can apply leverage to the offset planes resulting in bending/snapping of the compartments relative to one another and causing the perforation break, thereby separating the compartments.

13 Claims, 23 Drawing Sheets

(56) References Cited

U.S. PATENT DOCUMENTS

| | | | | |
|---|---|---|---|---|
| 2016/0280413 | A1* | 9/2016 | Kaminski | B65D 1/30 |
| 2018/0072459 | A1* | 3/2018 | Davey | B65D 77/20 |

FOREIGN PATENT DOCUMENTS

| | | | |
|---|---|---|---|
| EP | 3277590 | A1 | 2/2018 |
| JP | 3082979 | U | 1/2002 |
| JP | 2005088950 | A | 4/2005 |
| JP | 4062378 | B2 | 3/2008 |
| JP | 2012224357 | A | 11/2012 |

OTHER PUBLICATIONS

International Preliminary Report on Patentability for PCT Application No. PCT/US2020/065215, dated Jul. 7, 2022, pp. 1-11.
Communication Pursuant To Article 94(3) EPC, European Patent Application No. 20841813.7, dated Oct. 22, 2024, pp. 1-7.

* cited by examiner

MULTI-COMPARTMENT TRAY

CROSS-REFERENCE TO RELATED APPLICATION

The present application relates and claims priority to U.S. Provisional Application 62/952,524 filed Dec. 23, 2019, the entirety of which is hereby incorporated by reference.

FIELD OF THE INVENTION

The present disclosure is directed generally to conjoined multi-compartment trays, and more particularly to such trays that are adapted to be separated into multiple, individual trays.

BACKGROUND

In packaging it is rather typical for multiple compartments in a tray to be conjoined, filled with the desired contents (i.e., food, pharmaceuticals), and then sealed for sale to an end user. The end user can then separate one compartment from the conjoined assembly to consume the contents in that compartment while leaving the other compartments in the assembly sealed (and conjoined if there are three or more compartments in the assembly). Separation of one compartment from the multi-tray assembly is typically done by tearing the tray along a two-dimensional perforated seam that extends along (and is co-planar with) the common edge between two compartments.

Typical materials for these types of multi-compartment trays to be composed of include polystyrene and polypropylene. Polystyrene exhibits stiff and brittle properties, while polypropylene exhibits plastic deformation early on in the deformation process, so it is generally considered a "tough" material. Toughness is defined as a material's ability to deform (plastically, not elastically) without breaking. In addition, polypropylene exhibits fatigue resistance, essentially retaining its shape after a lot of torsion, bending, and/or flexing.

Due to these material properties, multi-compartment containers having a perforated seam generally require the user to actually tear the compartments apart, as opposed to bending/snapping them to separate them. The tearing can be difficult for a user with limited hand strength and can also result in sharp edges being formed if the tear does not follow the perforated seam perfectly. In addition, because the perforation is in the same place as the compartments' edges, the edge structure between the compartments is structurally weak/non-rigid, thereby making the package more susceptible to bending/twisting along the common edge and requiring more user support when carrying the multi-compartment tray.

Accordingly, there is a need in the art for a packaging solution for multi-compartment trays that permit easier separation of the compartments.

There is a further need in the art for a packaging solution for multi-compartment trays that enhances the rigidity of the article.

SUMMARY

The present disclosure is directed to a multi-compartment tray.

According to an aspect is a multi-compartment tray, comprising first and second compartments conjoined along a first longitudinal axis and each of which contains an edge that extends along the first longitudinal axis and in a first plane. The multi-compartment tray further comprises a perforation region that conjoins the first and second compartments, wherein the perforation region comprises a plurality of first and second cut-away regions formed in the edges of the first and second compartments, respectively, each of which is laterally spaced from the others along the first longitudinal axis; a first plurality of perforation tabs joining the first and second compartments and extending in series along a second longitudinal axis that is parallel to and laterally offset from the first longitudinal axis; and a second plurality of perforation tabs joining the first and second compartments and extending in series along a third longitudinal axis that is parallel to and laterally offset from the first and second longitudinal axes.

According to an embodiment, the first and second compartments are shaped as a polygon.

According to an embodiment, the first and second compartments are rectangular in shape.

According to an embodiment, the first and second compartments are semicircular in shape.

According to an embodiment, there are at least four sets of first and second cut-away regions formed in the edges of the first and second compartments.

According to an embodiment, there are at least five sets of first and second cut-away regions formed in the edges of the first and second compartments.

According to an aspect is a multi-compartment tray, comprising first and second compartments having first and second edges, respectively, that extend towards one another in a first plane; a wave-shaped perforation region having a series of undulating crests and troughs that extend in series with respective tangents that extend in second and third planes, respectively, and are parallel to and laterally offset from the first plane and from each other, wherein at least some of the undulating crests and troughs comprise a perforation tab formed thereon that connect the first and second compartments.

According to an aspect is a die for forming a perforation region in a multi-compartment tray, comprising an edge that extends in a wave pattern and comprising a plurality of sequentially spaced crests and troughs; and indented regions formed in at least some of the crests and troughs.

According to an aspect is a method for separating a first compartment from a second compartment in a multi-compartment tray in which the first and second compartments have first and second edges, respectively, that extend towards one another in a first plane, and a wave-shaped perforation region having a series of undulating crests and troughs that extend in series with respective tangents that extend in second and third planes, respectively, and are parallel to and laterally offset from the first plane and from each other, wherein at least some of the undulating crests and troughs comprise a perforation tab formed thereon that connect the first and second compartments, the method comprising bending the first compartment relative to the second compartment about an axis that extends along the perforation region; and causing each perforation tab to break and the first compartment to separate from the second compartment.

These and other aspects of the invention will be apparent from the embodiments described below.

BRIEF DESCRIPTION OF THE DRAWINGS

The present invention will be more fully understood and appreciated by reading the following Detailed Description in conjunction with the accompanying drawings, in which.

DETAILED DESCRIPTION OF EMBODIMENTS

The present disclosure describes a multi-compartment tray 10. Tray 10 comprises multiple compartments, two compartments 12 and 14 being used for purposes of illustration although more than two could be formed (e.g., four, six, etc.), that are connected at the time of sale and then able to be split into separate, detached compartments by a user, as will be described hereinafter. Tray 10 is preferably composed of polypropylene, polystyrene, polyethylene, PET, PVC, or any combination of these, with or without barrier materials such as EVOH, minerals, thermoplastic starch, and other well understood barrier materials.

Figure 1:
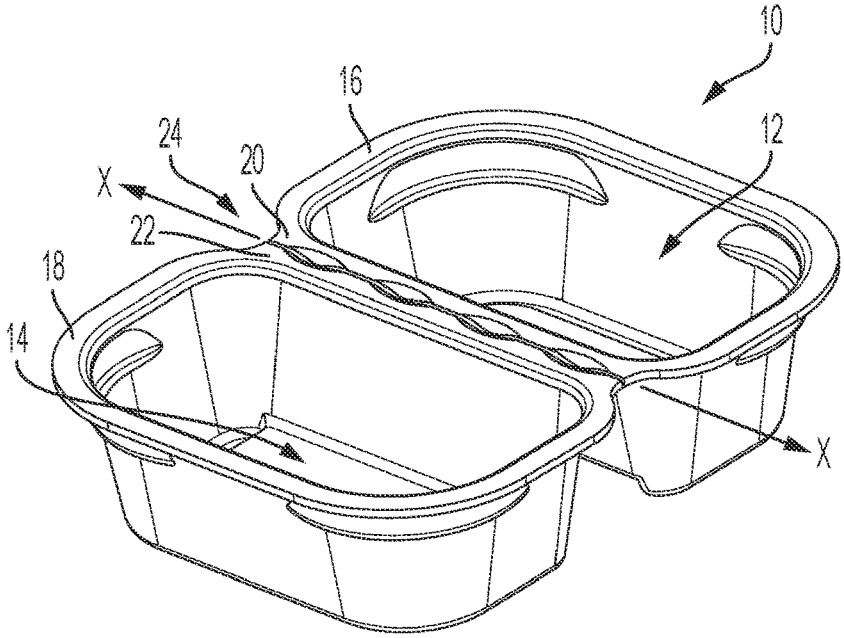
FIG. 1 is a perspective view of a multi-compartment container, in accordance with an embodiment.
Figure 2:
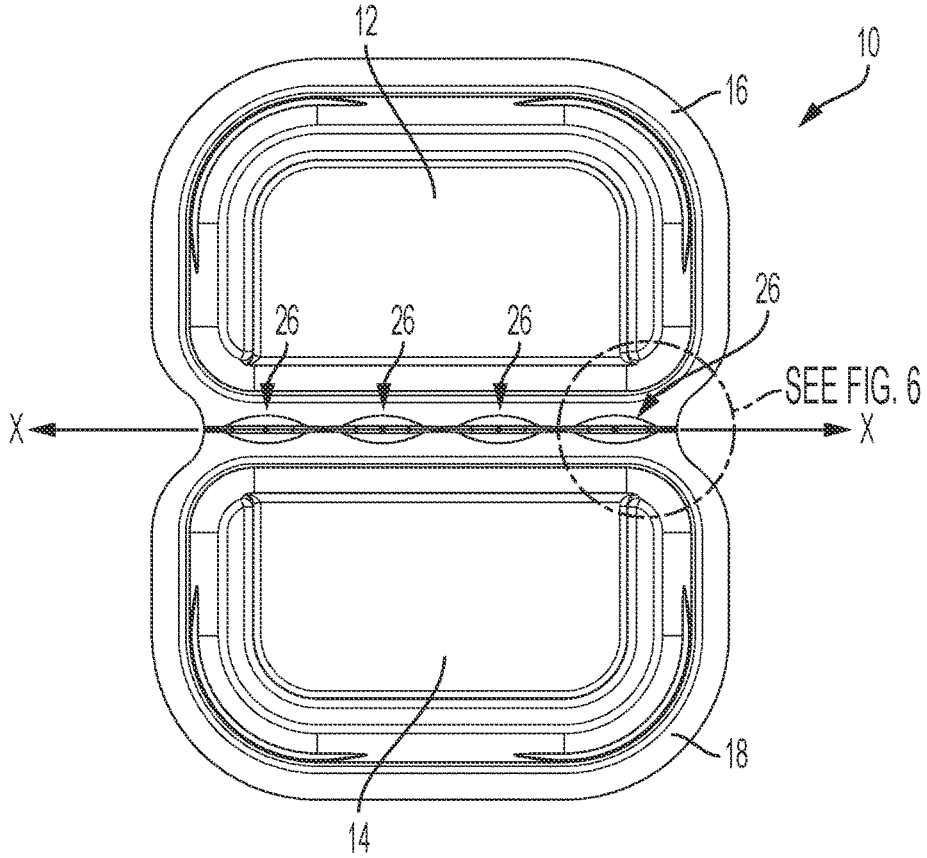
FIG. 2 is a top plan view of a multi-compartment container, in accordance with an embodiment.
Figure 3:
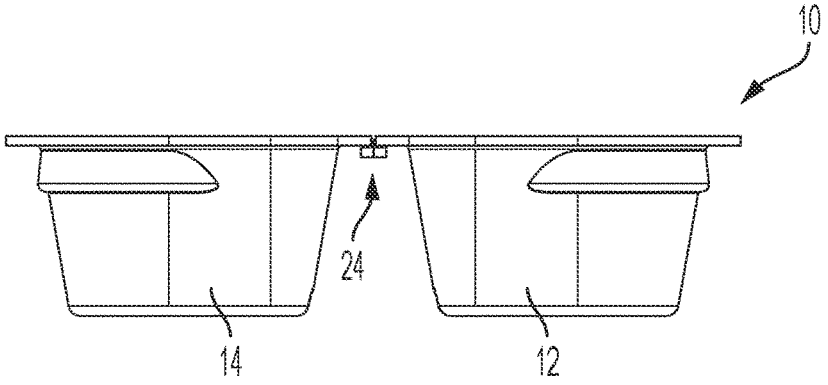
FIG. 3 is a side elevation view of a multi-compartment container, in accordance with an embodiment.
Figure 4:
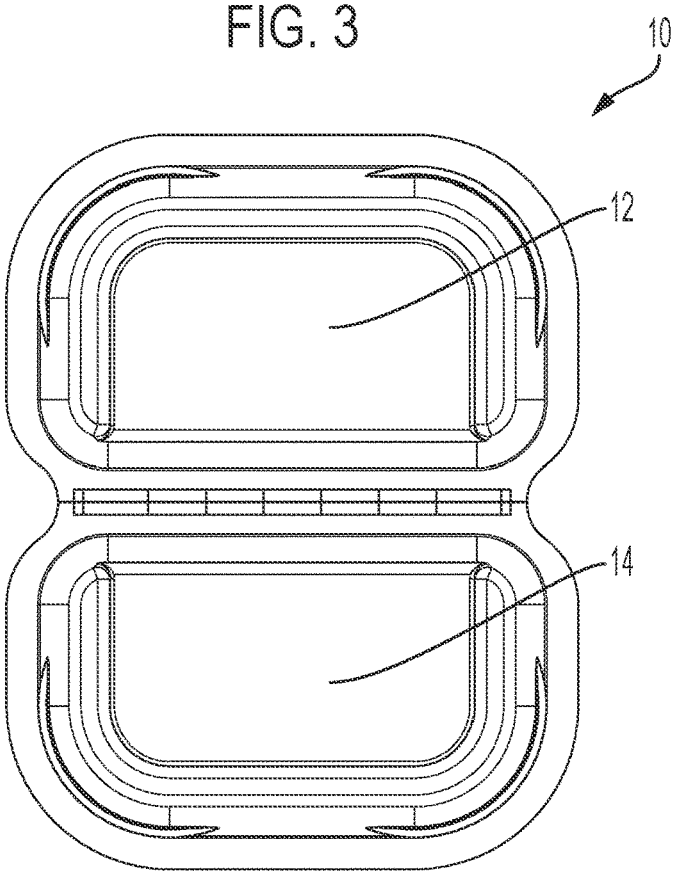
FIG. 4 is a bottom plan view of a multi-compartment container, in accordance with an embodiment.
Figure 5:
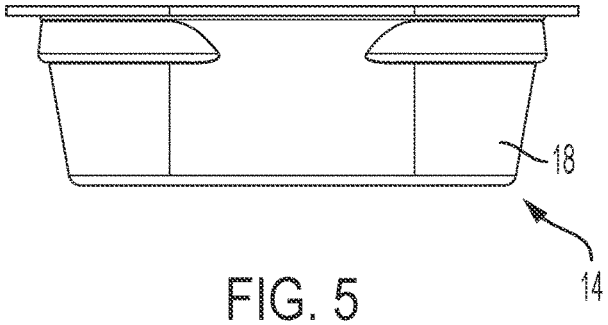
FIG. 5 is a front elevation view of a multi-compartment container, in accordance with an embodiment.
Figure 6:
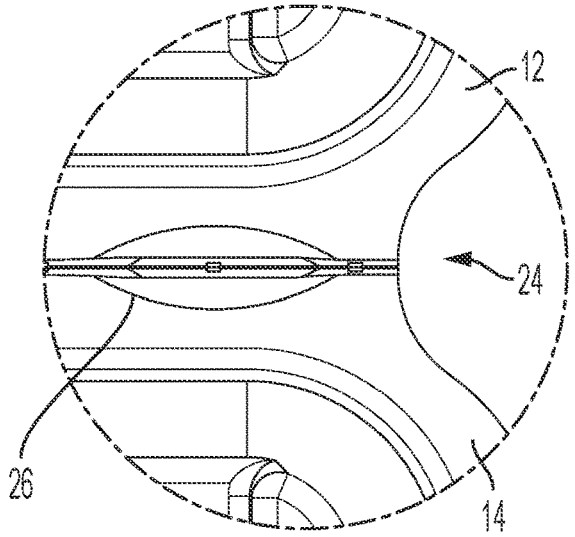
FIG. 6 is an enlarged view taken along region 6-6 of FIG. 2, in accordance with an embodiment.
Figure 7:
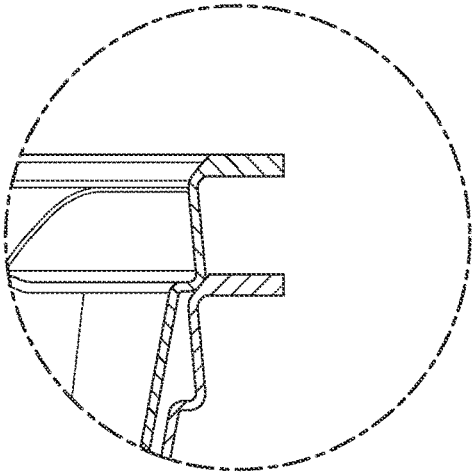
FIG. 7 is an enlarged view showing the nesting/stacking of two trays, in accordance with an embodiment.
Figure 8:
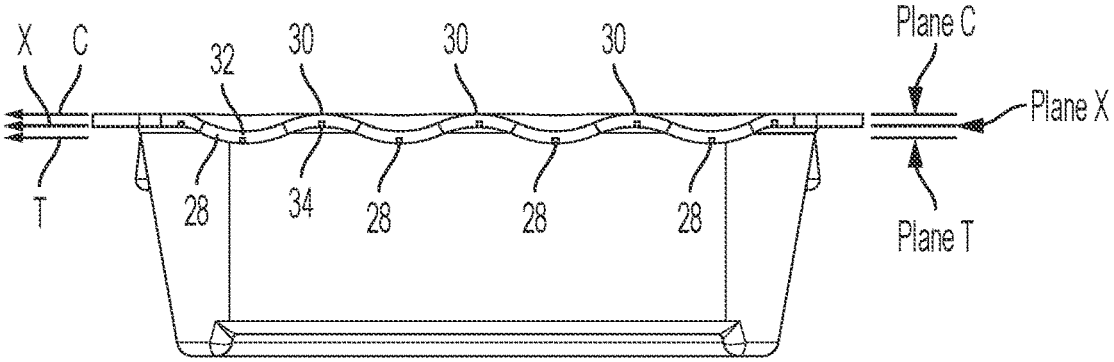
FIG. 8 is a front elevation view of one container after being split from other container, in accordance with an embodiment.
Figure 9A:
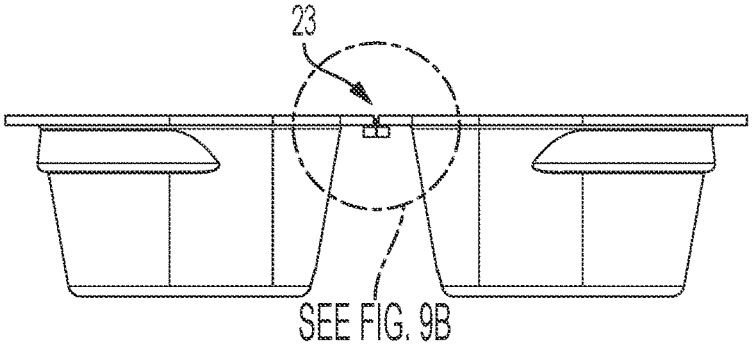
FIGS. 9A and 9B are side elevation and a detailed view, respectively, illustrating the angled gap between compartments, in accordance with an embodiment.
Figure 9B:
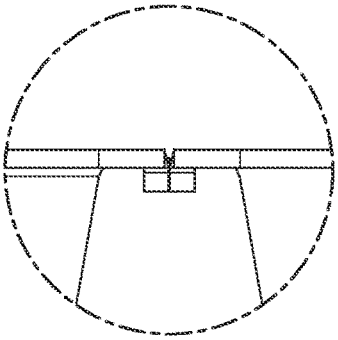
Figure 10A:
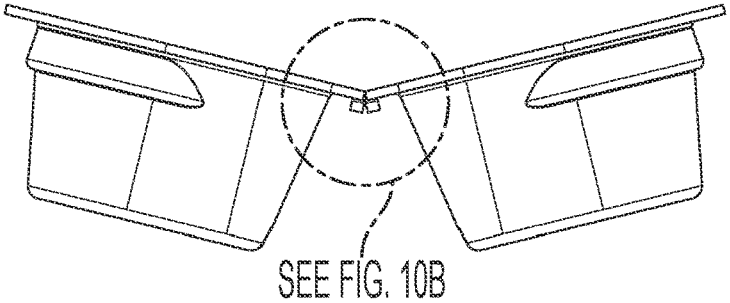
FIGS. 10A and 10B are side elevation and a detailed view, respectively, illustrating the gap edges used as leverage to facilitate separation of compartments, in accordance with an embodiment.
Figure 10B:
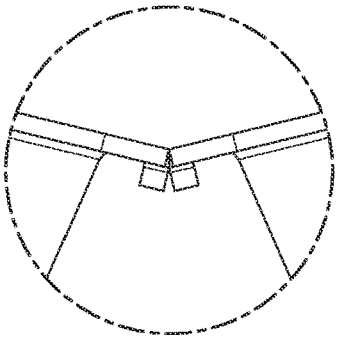
Figure 11A:
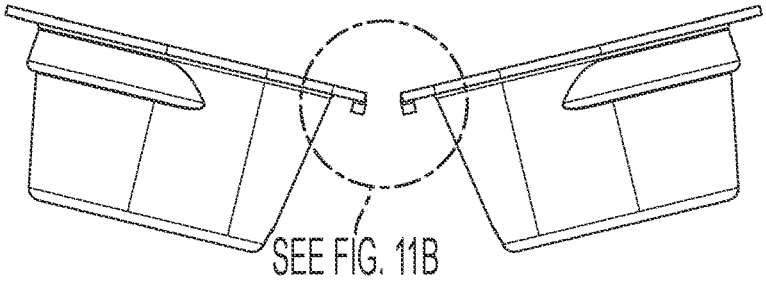
FIGS. 11A and 11B are side elevation and a detailed view, respectively, illustrating the post-separation of compartments, in accordance with an embodiment.
Figure 11B:
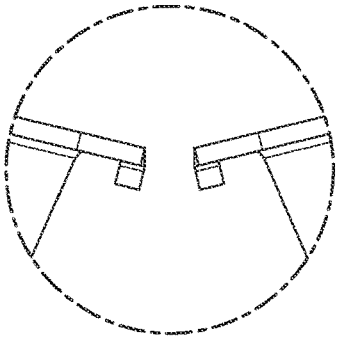
Figure 12A:
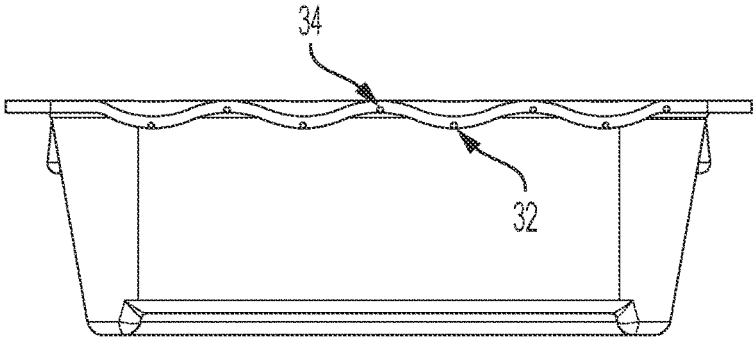
FIGS. 12A and 12B are a front elevation and a perspective view, respectively, illustrating the perforation tabs post-separation of compartments, in accordance with an embodiment.
Figure 12B:
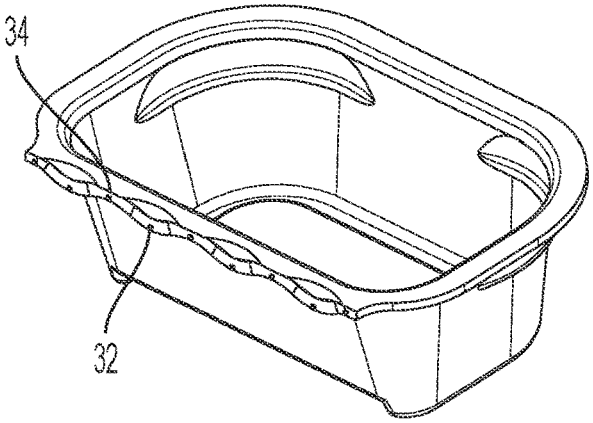
Figure 13:
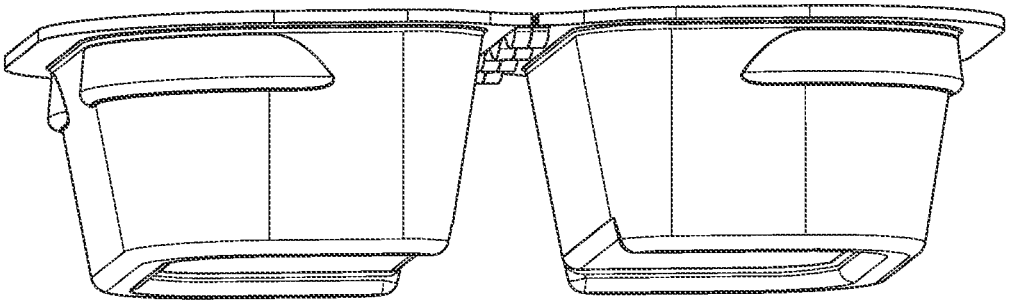
FIG. 13 is a perspective view of a multi-compartment container, in accordance with an embodiment.
Figure 14:
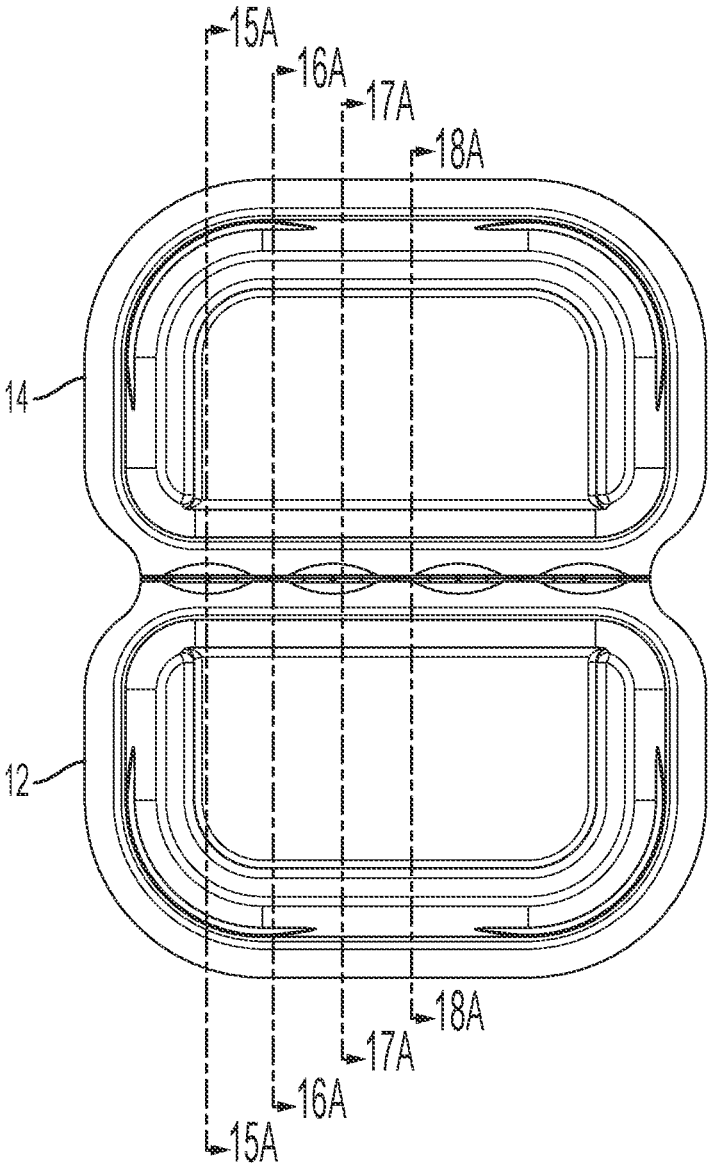
FIG. 14 is a top plan view of a multi-compartment container, in accordance with an embodiment.
Figure 16B:
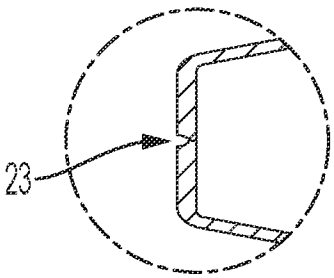
FIGS. 16A and 16B are a cross-sectional view taken along section line 16-16 of FIG. 14 and a detailed view taken along detail area AQ of FIG. 16A, respectively, in accordance with an embodiment.
Figure 16A:
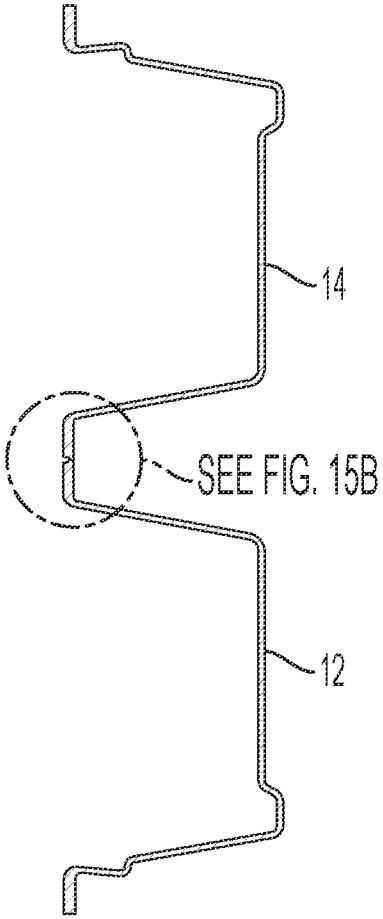
Figure 15B:
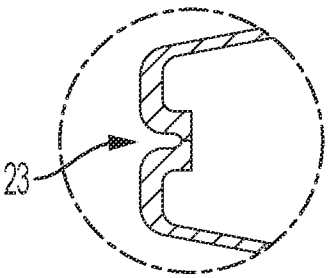
FIGS. 15A and 15B are a cross-sectional view taken along section line 15-15 of FIG. 14 and a detailed view taken along detail area AP of FIG. 15A, respectively, in accordance with an embodiment.
Figure 15A:
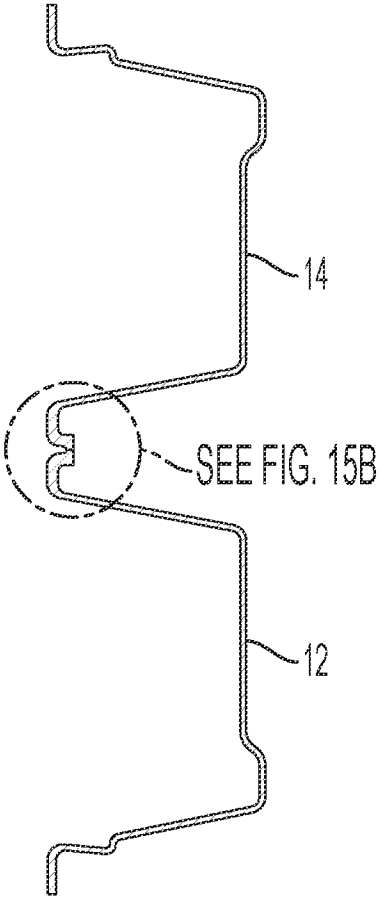
Figure 18B:
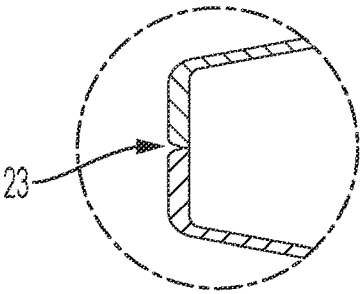
FIGS. 18A and 18B are a cross-sectional view taken along section line 18-18 of FIG. 14 and a detailed view taken along detail area AO of FIG. 18A, respectively, in accordance with an embodiment.
Figure 18A:
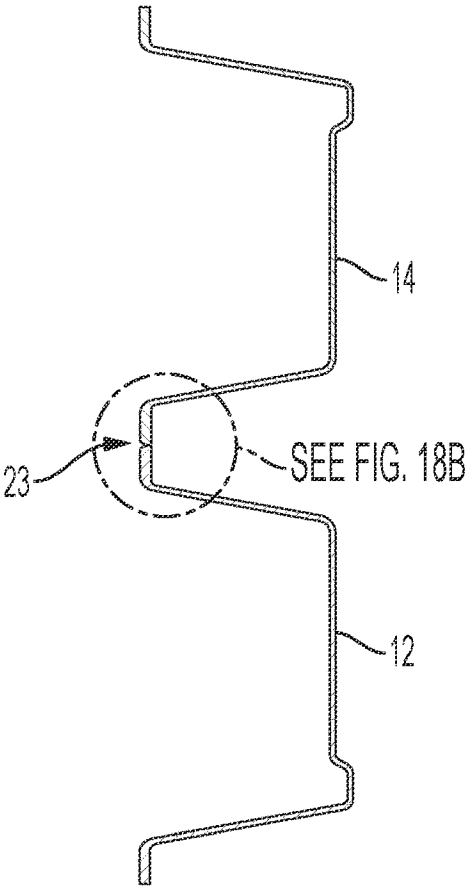
Figure 17B:
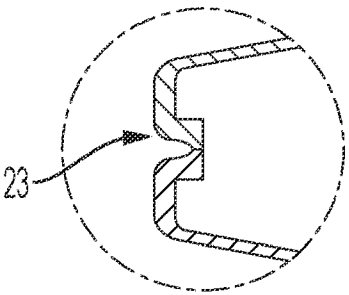
FIGS. 17A and 17B are a cross-sectional view taken along section line 17-17 of FIG. 14 and a detailed view taken along detail area AR of FIG. 17A, respectively, in accordance with an embodiment.
Figure 17A:
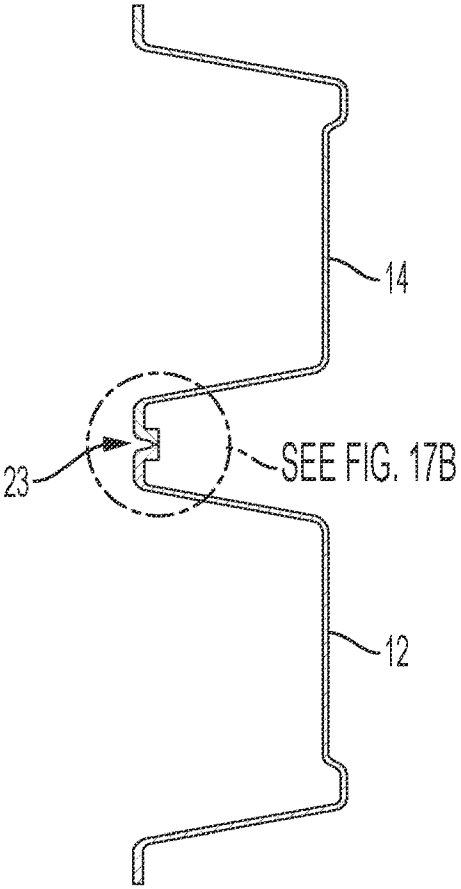
Figure 19:
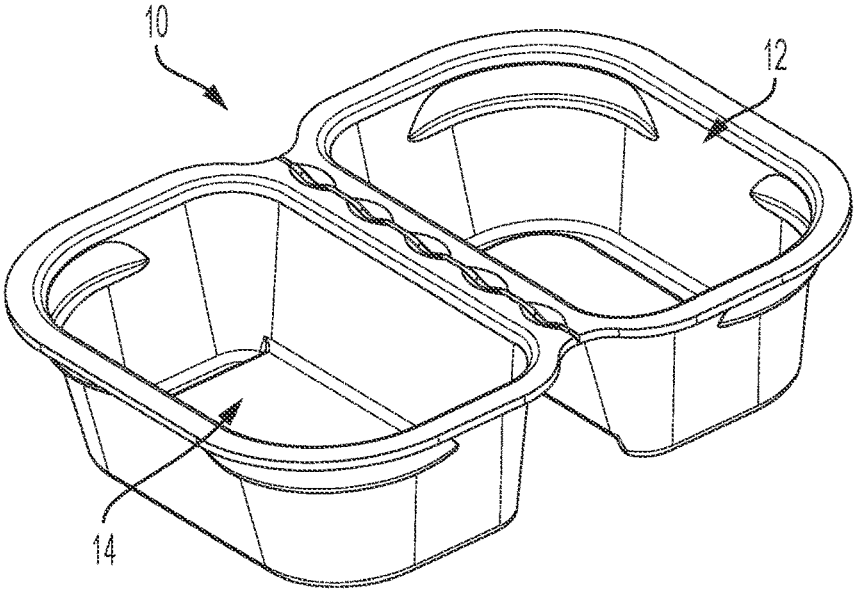
FIG. 19 is a perspective view of a multi-compartment container, in accordance with an embodiment.
Figure 20:
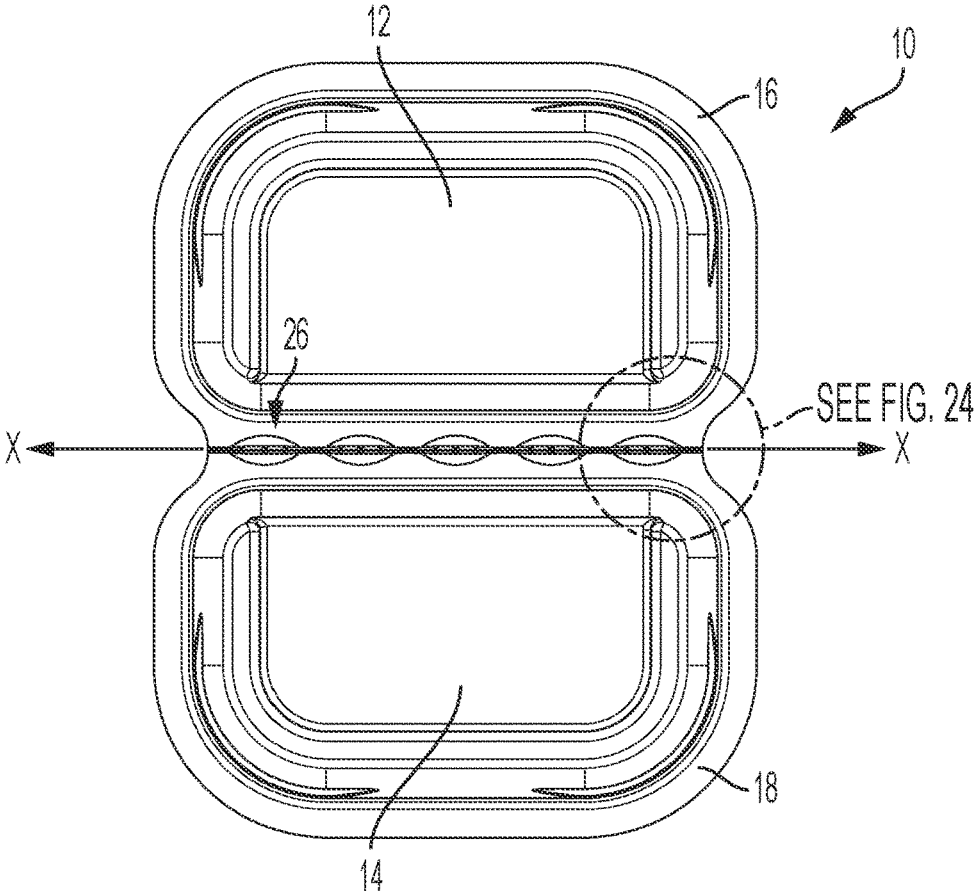
FIG. 20 is a top plan view of a multi-compartment container, in accordance with an embodiment.
Figure 21:
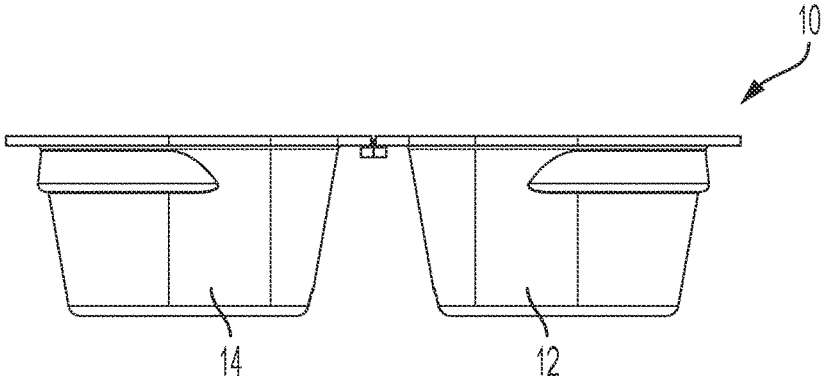
FIG. 21 is a side elevation view of a multi-compartment container, in accordance with an embodiment.
Figure 22:
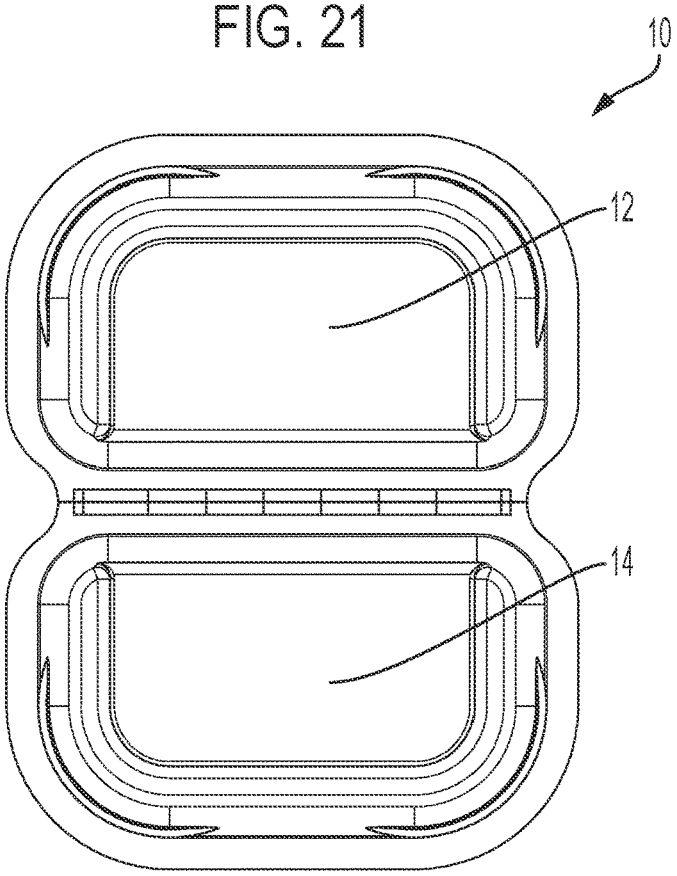
FIG. 22 is a bottom plan view of a multi-compartment container, in accordance with an embodiment.
Figure 23:
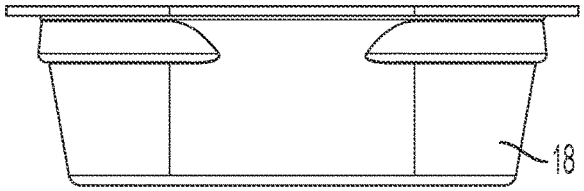
FIG. 23 is a front elevation view of a multi-compartment container, in accordance with an embodiment.
Figure 24:
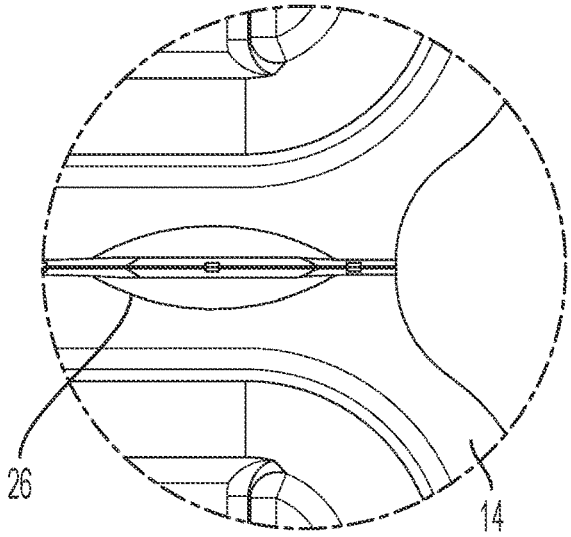
FIG. 24 is an enlarged view taken along region 6-6 of FIG. 2, in accordance with an embodiment.
Figure 25:
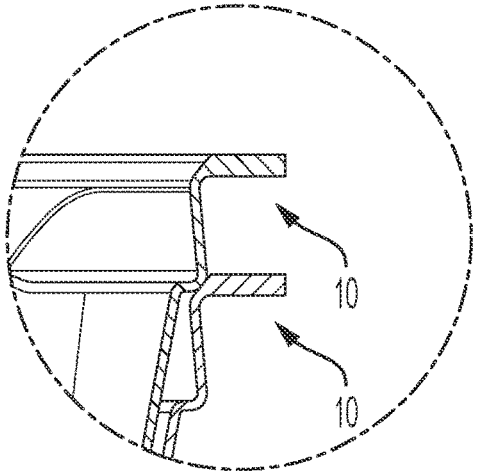
FIG. 25 is an enlarged view showing the nesting/stacking of two trays, in accordance with an embodiment.
Figure 26:
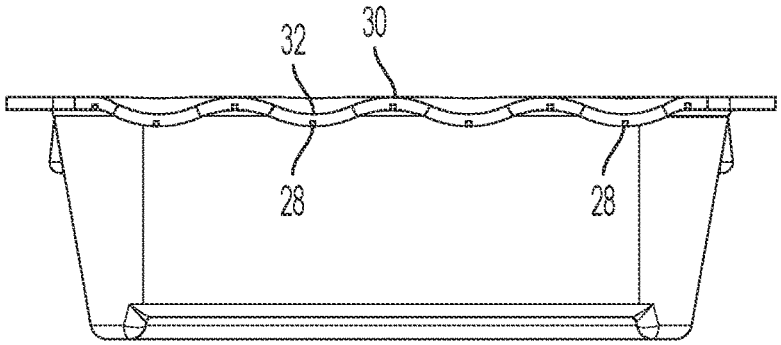
FIG. 26 is a front elevation view of one container after being split from other container, in accordance with an embodiment.
Figure 27:
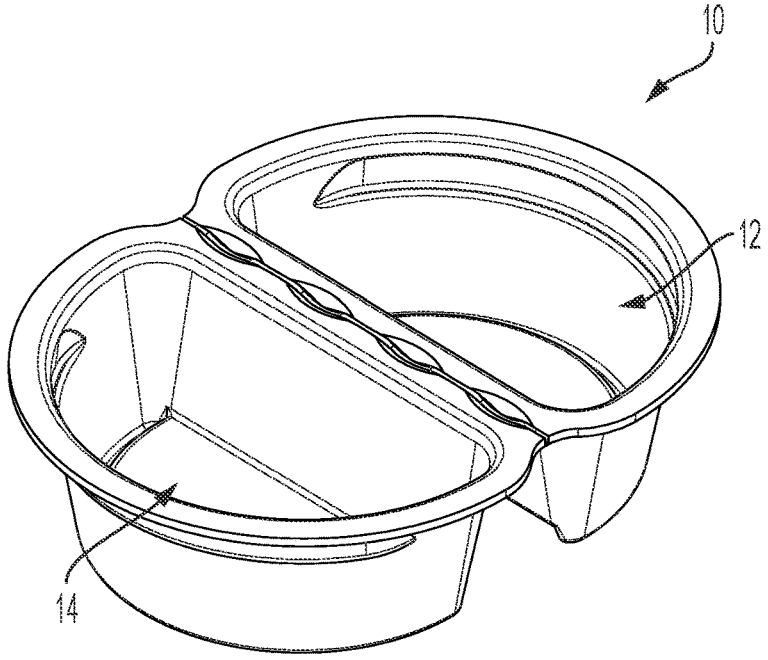
FIG. 27 is a perspective view of a multi-compartment container, in accordance with an embodiment.
Figure 28:
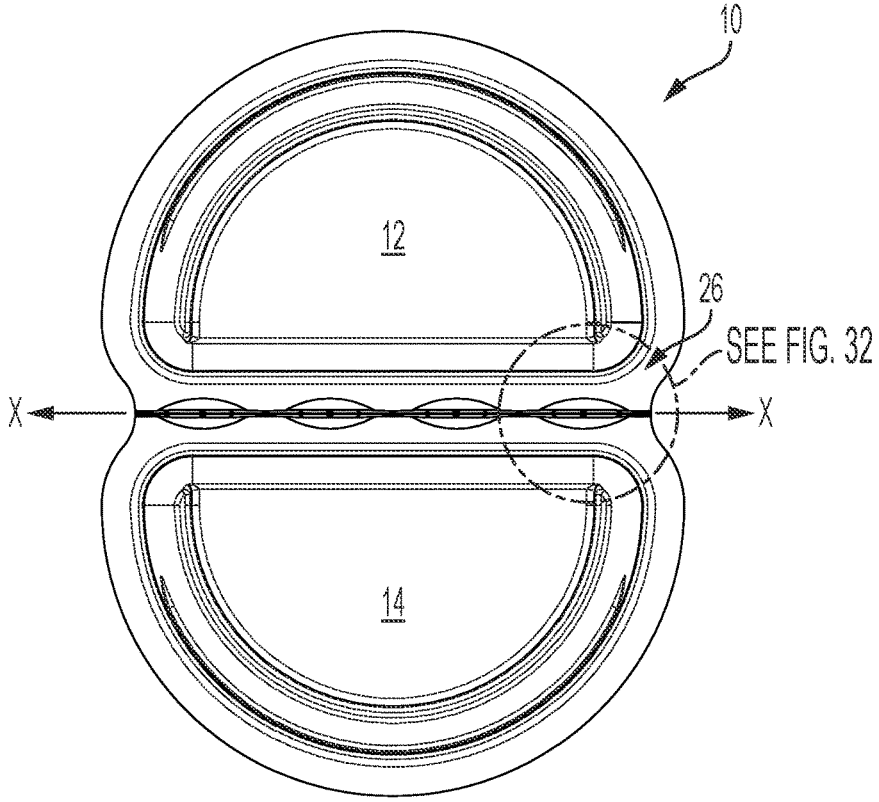
FIG. 28 is a top plan view of a multi-compartment container, in accordance with an embodiment.
Figure 29:
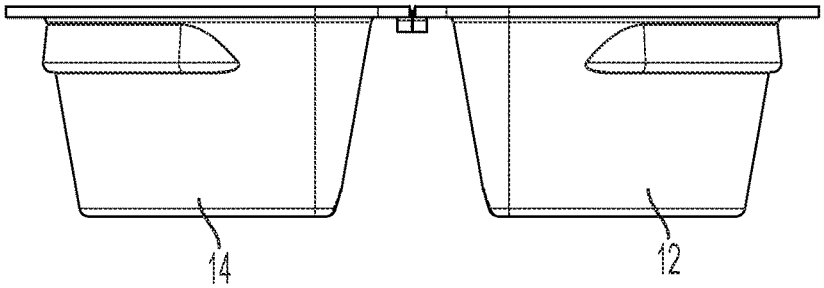
FIG. 29 is a side elevation view of a multi-compartment container, in accordance with an embodiment.
Figure 30:
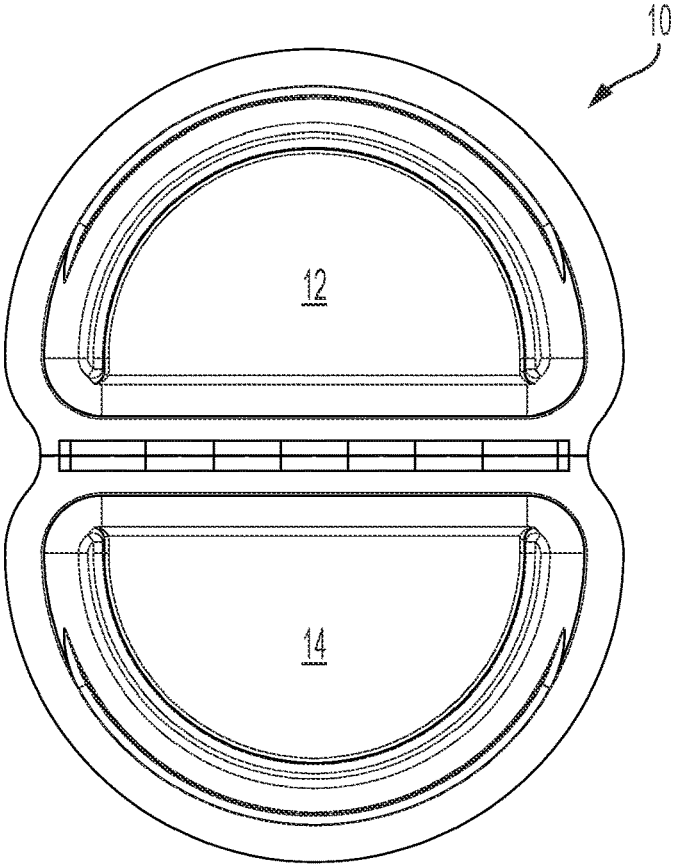
FIG. 30 is a bottom plan view of a multi-compartment container, in accordance with an embodiment.
Figure 31:
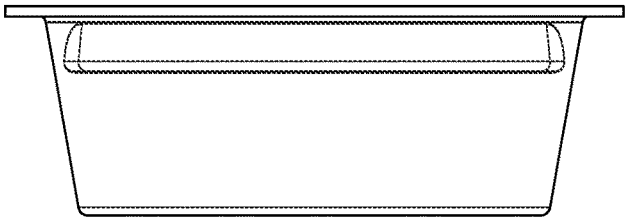
FIG. 31 is a front elevation view of a multi-compartment container, in accordance with an embodiment.
Figure 32:
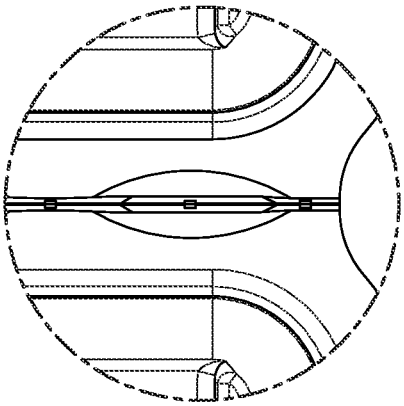
FIG. 32 is an enlarged view taken along region 6-6 of FIG. 2, in accordance with an embodiment.
Figure 33:
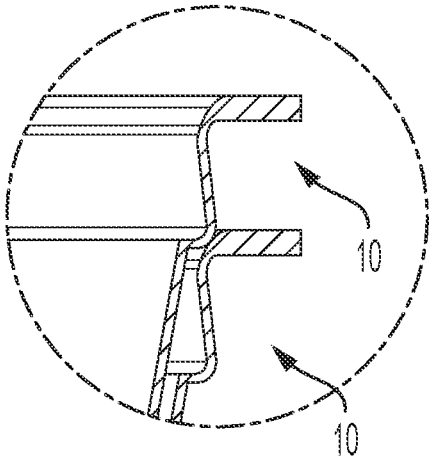
FIG. 33 is an enlarged view showing the nesting/stacking of two trays, in accordance with an embodiment.
Figure 34:
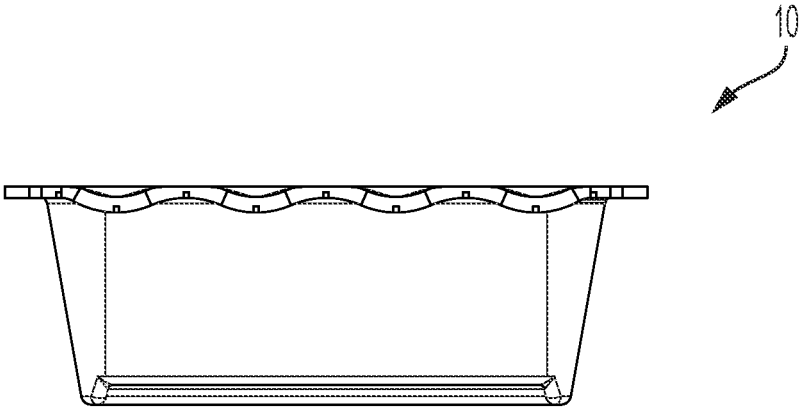
FIG. 34 is a front elevation view of one container after being split from other container, in accordance with an embodiment.

Referring to FIG. 1, in one embodiment, is a multi-compartment tray, designated generally by reference numeral 10, comprising first and second compartments 12 and 14, respectively, adapted to hold contents, such as food, liquids, solids, nutraceuticals, and pharmaceuticals, therein. First and second compartments 12 and 14 include upwardly facing flanges 16 and 18, respectively, which extend in a common plane F. Each flange 16 and 18 includes a terminal edge 20 and 22, respectively, that are positioned adjacent to one another but are slightly separated by a small angled and/or notched gap 23 (e.g., V-shaped as shown most clearly in FIGS. 9A and 9B) from one another on either side of an elongated axis X-X. A perforation region, designated generally by reference numeral 24, generally extending along axis X-X joins compartments 12 and 14 together. In use, a user may snap (by bending) tray 10 about axis X-X to separate one compartment from the other.

Perforation region 24 comprises a series of perforation waves, each designated generally by reference number 26. Notably, the "wave" can be of a typical sinusoidal shape as shown, but could take other shapes, such as saw tooth or truncated saw tooth as well. Each wave 26 comprises a trough 28 and a crest 30. A tangent to each trough 28 of each wave 26 extends along an axis A-A and in a plane T that is parallel to and offset from axis X-X and plane F. Likewise, a tangent to each crest 30 of each wave 26 extends along an axis B-B and in a plane C that is parallel to and offset from axes A-A and X-X and planes T and F.

During manufacturing, one perforation tab 32, 34 is formed on each trough 28 and crest 30, respectively, and the containers 12 and 14 are joined by attachment/bonding of corresponding tabs 32, 34. Thus, the sole attachment between compartments 12 and 14 is achieved through connection/bonding of tabs 32 and 34 on correspondingly positioned troughs 28 and waves 30. Therefore, as shown in FIGS. 9-12, by holding and bending/snapping compartments 12 and 14 about axis X-X, the corresponding tabs 32 and 34 will break apart, thereby separating compartments 12 and 14. Because the connection is done at the series of tabs 32/34, as opposed to being a bond along the entire edges of the compartments, the amount of force required to break the attachment between tabs is relatively minor and certainly significantly less than would be required with a continuous attachment/bond. Moreover, the perforations created by the tabs 32/34 lie in two planes thus creating a 3-dimensional perforation structure which elongates and stretches the leverage points further facilitating the clean and relative low force break between compartments. Accordingly, a user can apply leverage across the offset planes to break the tabs resulting in a "snapping" a part of the two compartments. Further this 3-dimensional perforation structure provides increased rigidity when the two compartments remain connected, as compared to a liner (or 2-dimensional) perforation.

With reference to FIGS. 15-18, the connectivity structure between corresponding tabs 32 and 34 can be seen most clearly. Further, the slight gap 23 that exists between compartments 12 and 14 in areas where tabs 32 and 34 are absent is shown in FIGS. 17A, 17B, 18A and 18B.

The number of waves 26 can vary depending on the size of containers 12/14. For example, there are 4 waves shown in the embodiment of FIGS. 1-14, five waves in the embodiments of FIGS. 19-25 and 36-43, one wave in the embodiment of FIGS. 44-53, and seven waves in the embodiment of FIGS. 54-61. Likewise, the shape of containers 12/14 can be formed as desired; for example rectangular (FIGS. 1-25), semicircular (FIGS. 28-33), or most any other shape (e.g., triangular, trapezoidal, circular, etc.), as long as the shape provides an elongated edge in which the wave perforations can be formed. Further, the angle at which the wave perforation regions 24 extend relative to the containers 12/14 can be transverse/perpendicular (for example, as in the embodiments of 1-33 and 44-58) or at any other non-orthogonal angle (for example, as in the embodiment of FIGS. 36-43). Finally, the number of containers 12/14 that can be a part of the multi-compartment tray 10 can be any number from two on, and can be of the same or different sizes/volumes. For example, the embodiment of FIGS. 54-61 comprises six compartments 202, 204, 206, 208, 210, 212 (the reference numerals differing from 12, 14 simply due to the exemplary nature of providing an embodiment that includes more than two compartments). In this embodiment, there are two lines of wave perforation regions 24 separating each compartment from its two neighboring compartments; and each of the two wave perforation areas associated with each container is perpendicularly oriented relative to the other (of course, other structural arrangements of compartments are possible with the angles between perforation regions varying depending on the geometric shape selected for the multi-compartment tray 10.)

Figure 35:
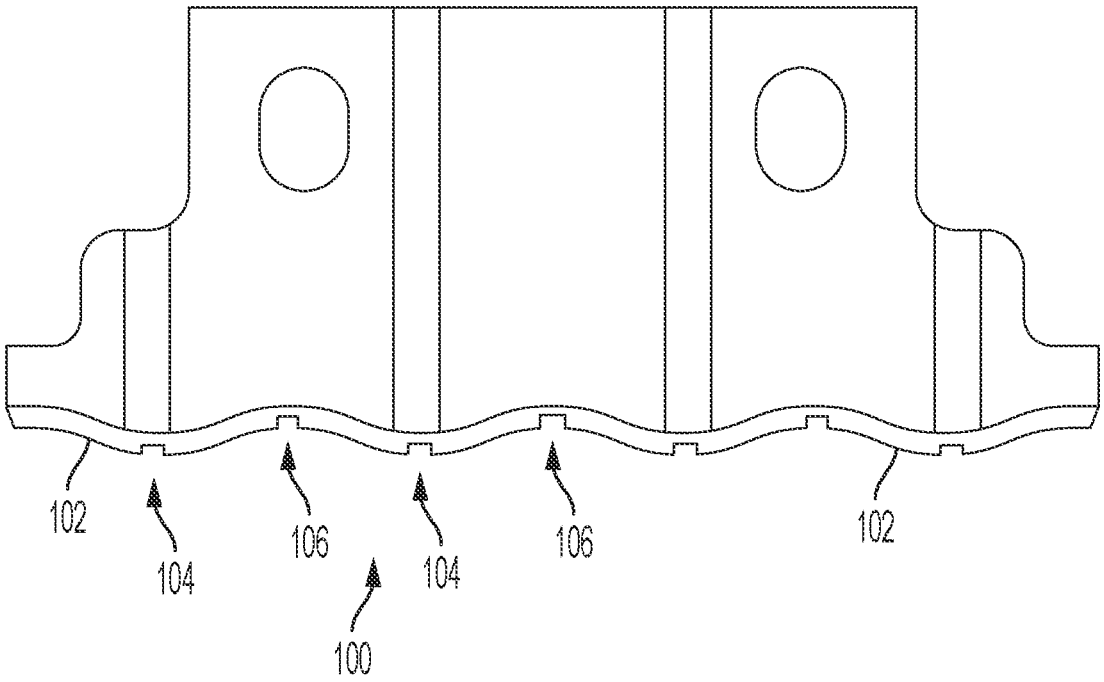
FIG. 35 is a perspective view of a die used in the manufacture of a multi-compartment container, in accordance with an embodiment.
Figure 36:
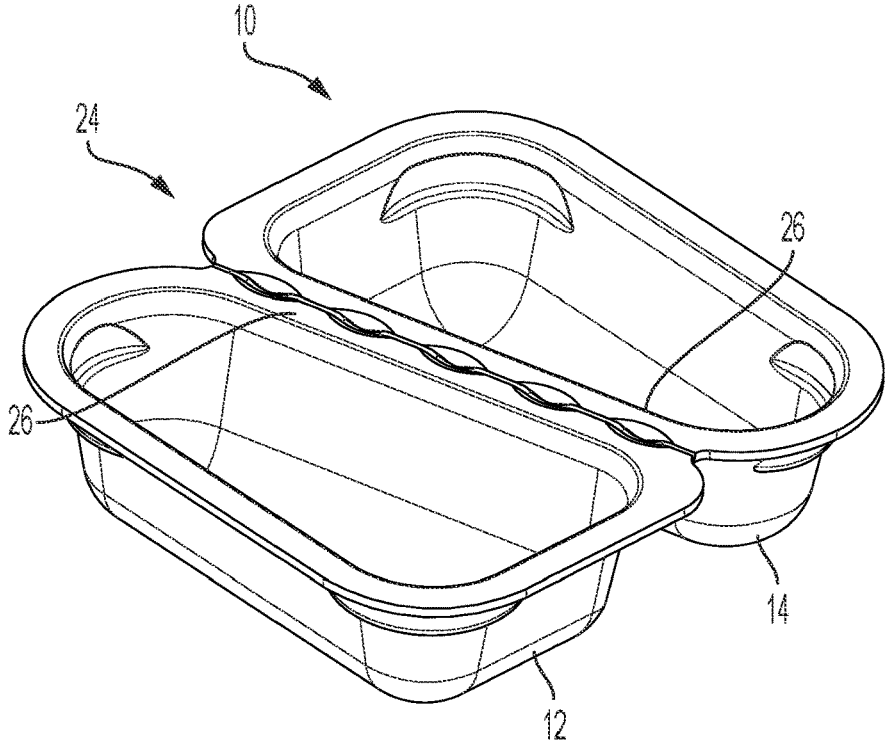
FIG. 36 is a perspective view of a multi-compartment container, in accordance with an embodiment.
Figure 37:
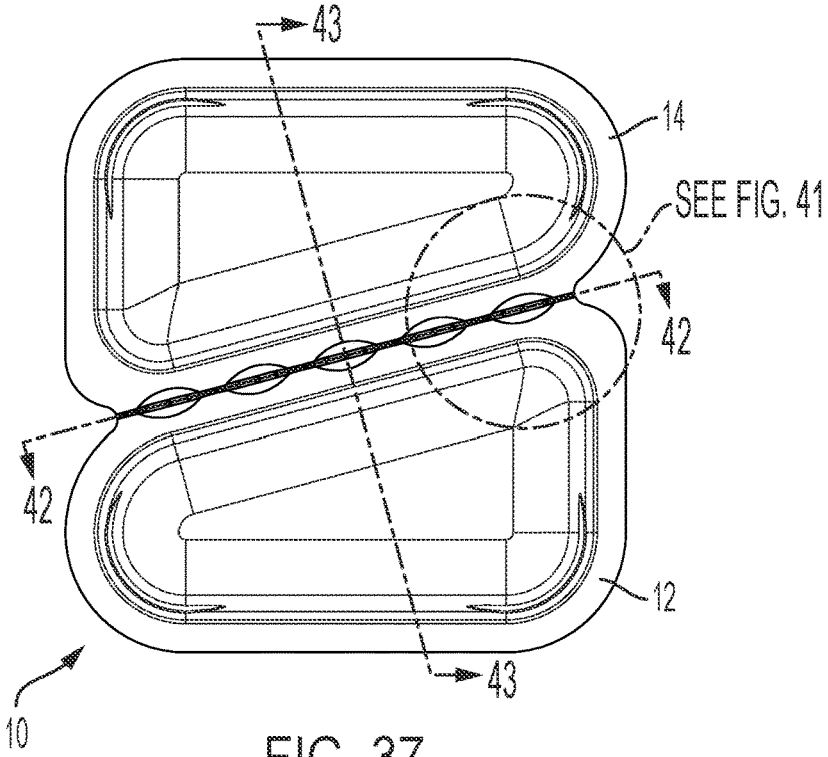
FIG. 37 is a top plan view of a multi-compartment container, in accordance with an embodiment.
Figure 38:
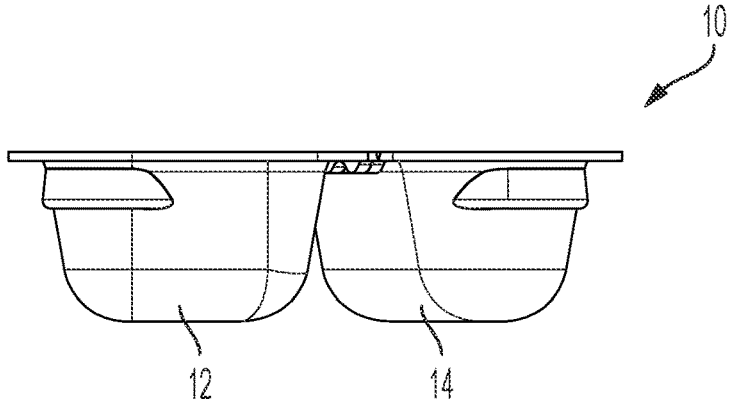
FIG. 38 is a side elevation view of a multi-compartment container, in accordance with an embodiment.
Figure 39:
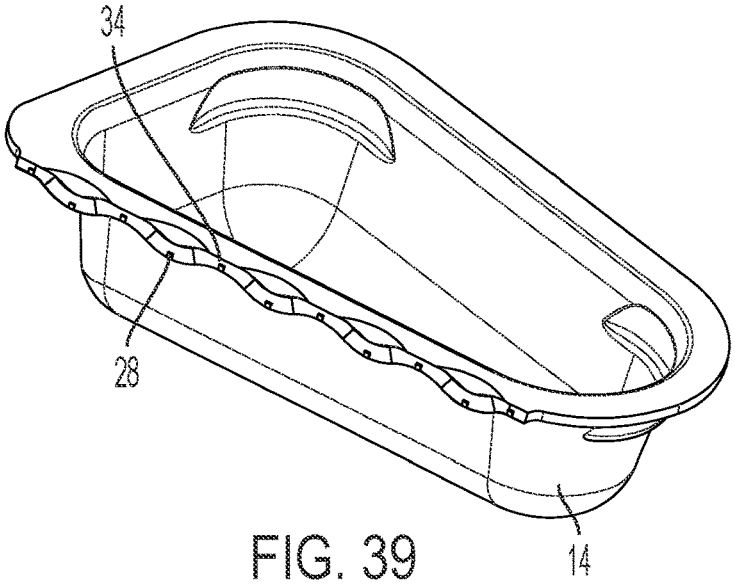
FIG. 39 is a perspective view of one container when separated from a multi-compartment container, in accordance with an embodiment.
Figure 40:
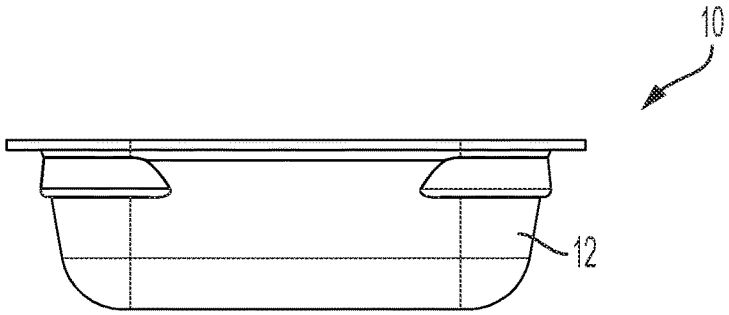
FIG. 40 is a front elevation view of a multi-compartment container, in accordance with an embodiment.
Figure 41:
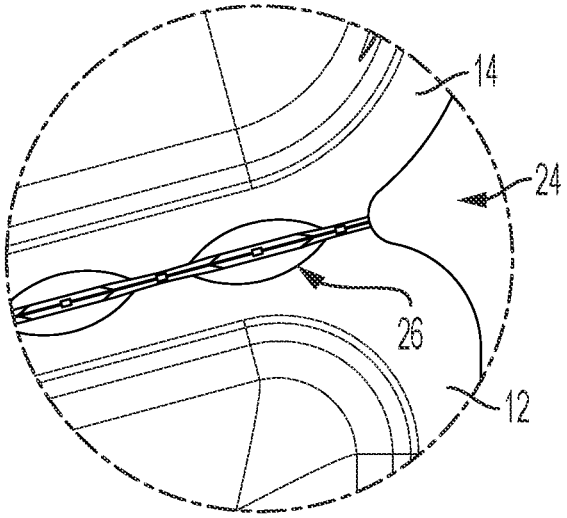
FIG. 41 is an enlarged view taken along region 41-41 of FIG. 37, in accordance with an embodiment.
Figure 42:
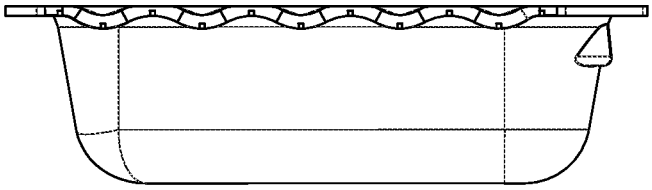
FIG. 42 is cross-sectional view taken along section line 42-42 of FIG. 27, in accordance with an embodiment.
Figure 43:
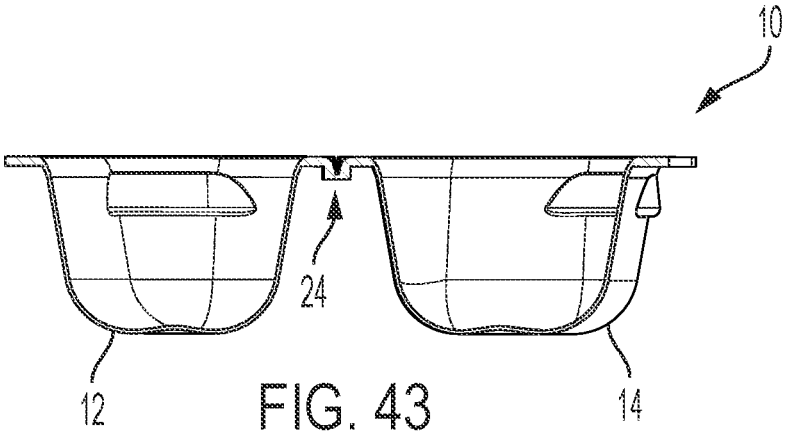
FIG. 43 is cross-sectional view taken along section line 43-43 of FIG. 27, in accordance with an embodiment.
Figure 44:
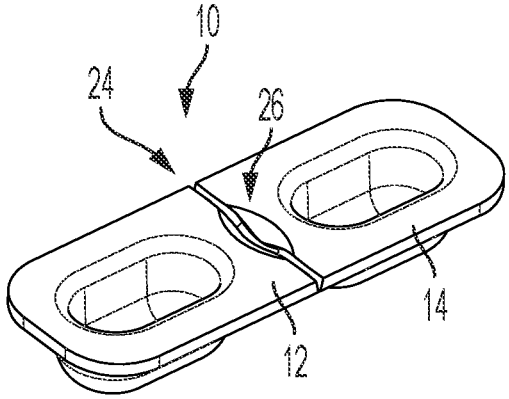
FIG. 44 is a perspective view of a multi-compartment container, in accordance with an embodiment.
Figure 45:
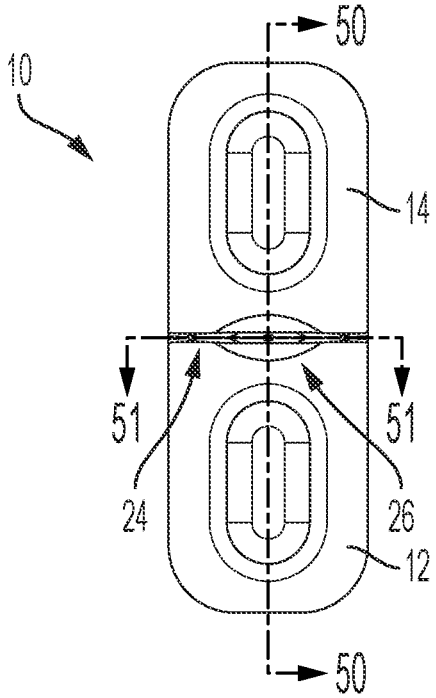
FIG. 45 is a top plan view of a multi-compartment container, in accordance with an embodiment.
Figure 46:
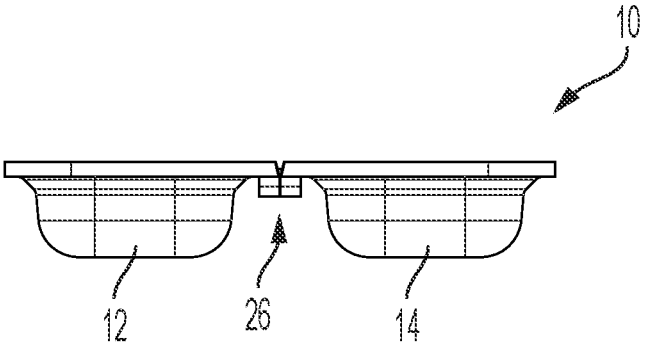
FIG. 46 is a side elevation view of a multi-compartment container, in accordance with an embodiment.
Figure 47:
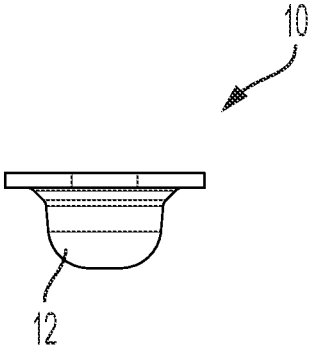
FIG. 47 is a front elevation view of a multi-compartment container, in accordance with an embodiment.
Figure 48:
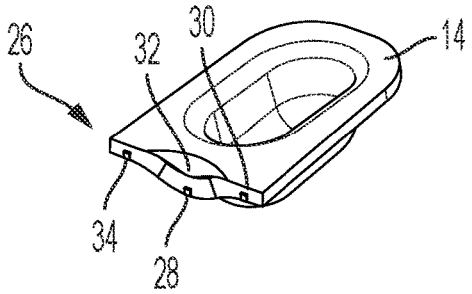
FIG. 48 is a perspective view of one container when separated from a multi-compartment container, in accordance with an embodiment.
Figure 49:
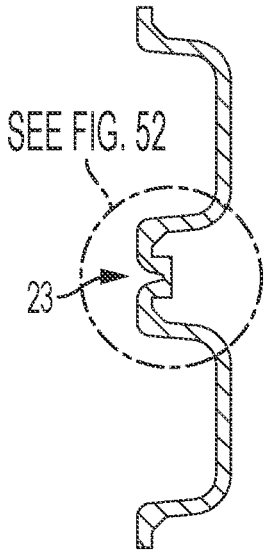
FIG. 49 is a cross-sectional view taken along section line 49-49 of FIG. 45, in accordance with an embodiment.
Figure 50:
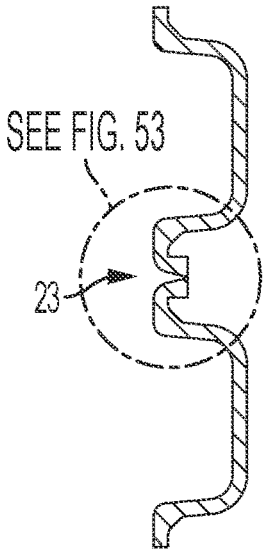
FIG. 50 is cross-sectional view taken along section line 50-50 of FIG. 45, in accordance with an embodiment.
Figure 51:
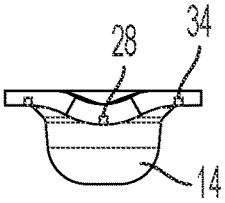
FIG. 51 is cross-sectional view taken along section line 51-51 of FIG. 45, in accordance with an embodiment.
Figure 52:
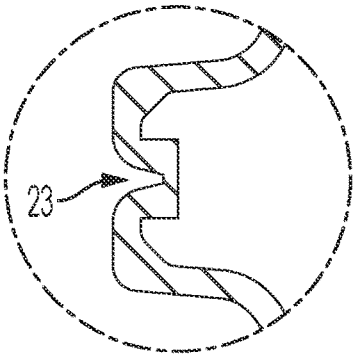
FIG. 52 is an enlarged view taken along region 52-52 of FIG. 49, in accordance with an embodiment.
Figure 53:
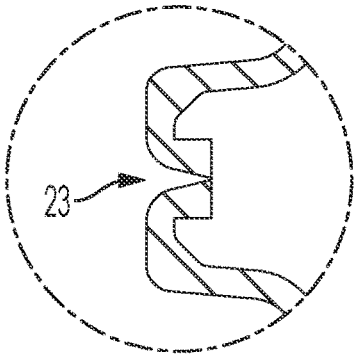
FIG. 53 is an enlarged view taken along region 53-53 of FIG. 50, in accordance with an embodiment.
Figure 54:
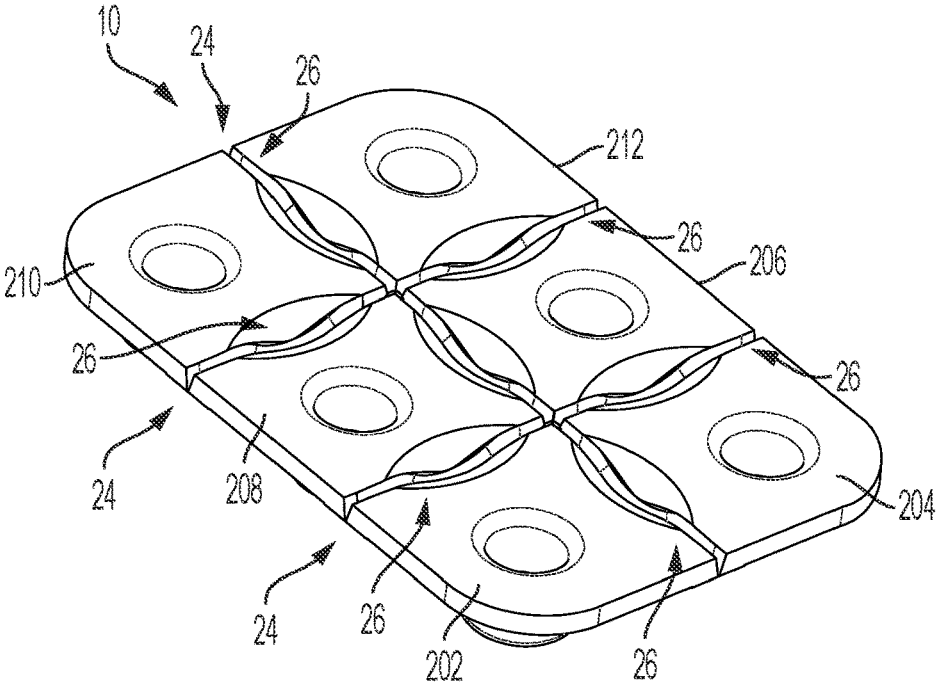
FIG. 54 is a perspective view of a multi-compartment container, in accordance with an embodiment.
Figure 55:
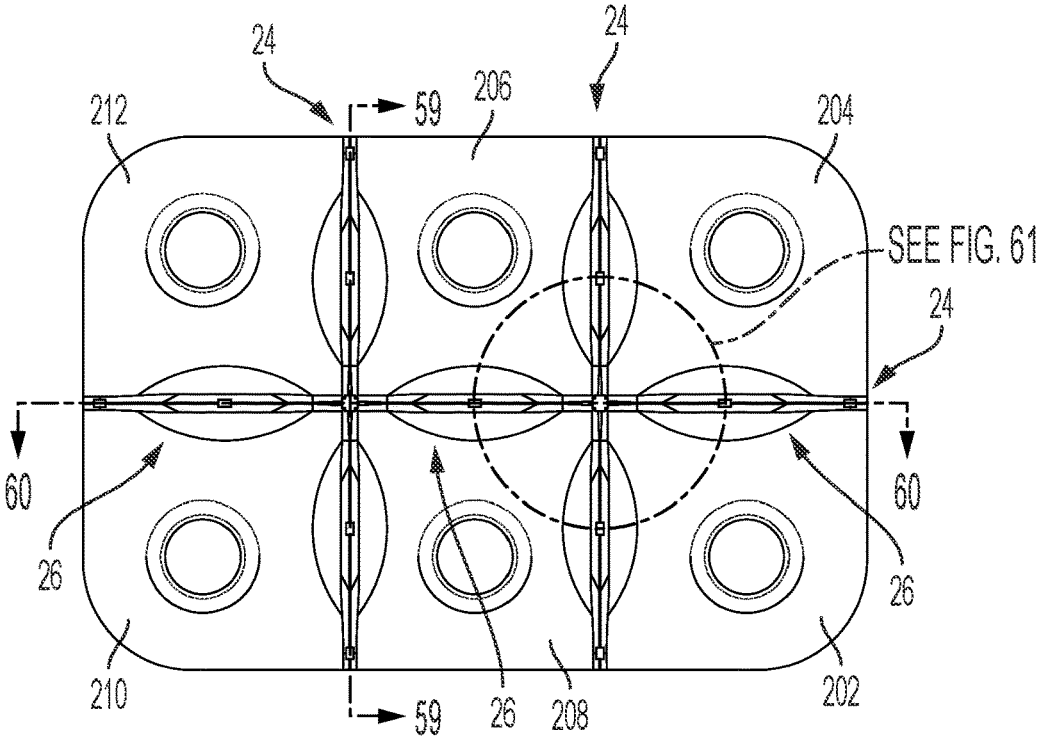
FIG. 55 is a top plan view of a multi-compartment container, in accordance with an embodiment.
Figure 56:
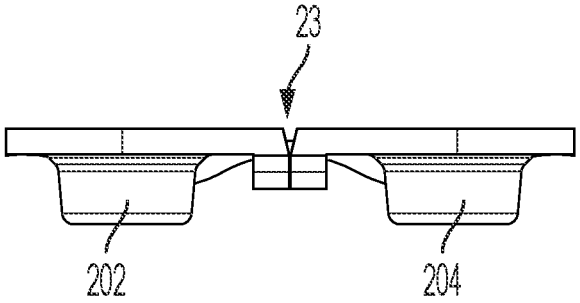
FIG. 56 is a side elevation view of a multi-compartment container, in accordance with an embodiment.
Figure 57:
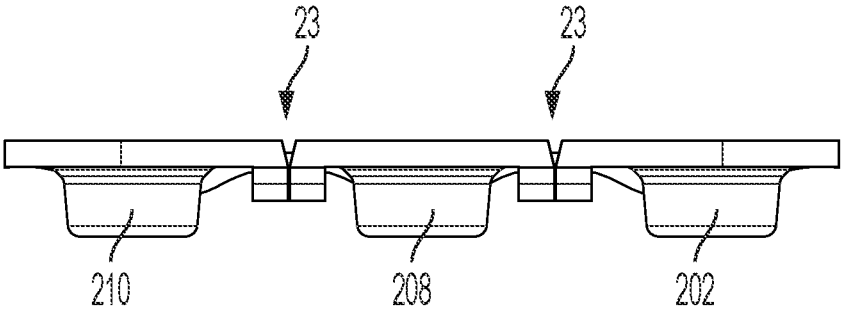
FIG. 57 is a front elevation view of a multi-compartment container, in accordance with an embodiment.
Figure 58:
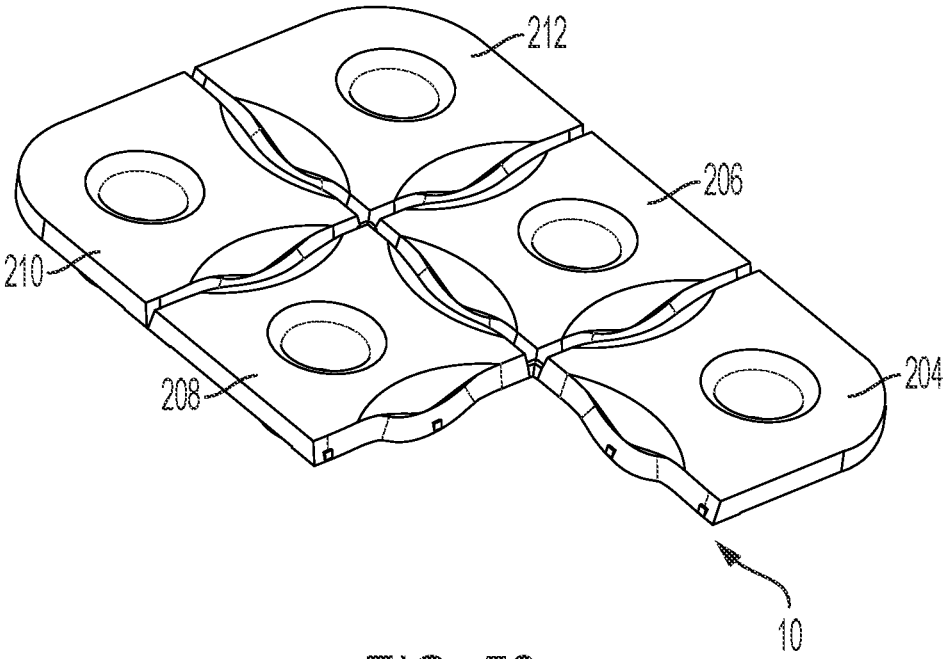
FIG. 58 is a perspective view of a multi-compartment container with one container separated therefrom, in accordance with an embodiment.
Figure 59:
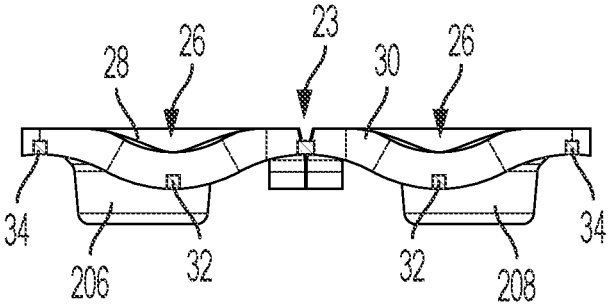
FIG. 59 is a cross-sectional view taken along section line 59-59 of FIG. 55, in accordance with an embodiment.
Figure 60:
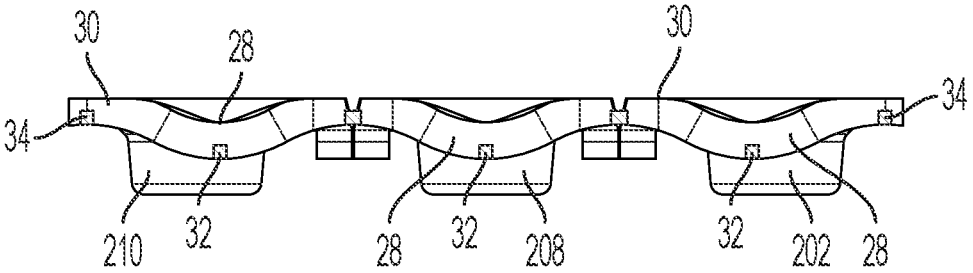
FIG. 60 is cross-sectional view taken along section line 60-60 of FIG. 55, in accordance with an embodiment.
Figure 61:
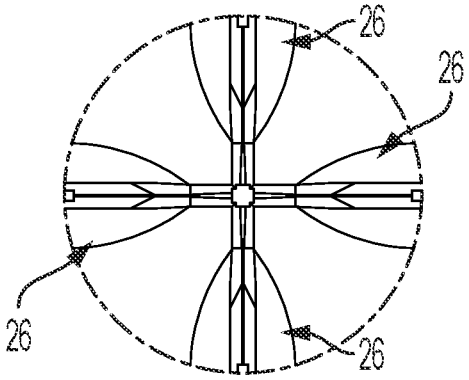
FIG. 61 is an enlarged view taken along region 61-61 of FIG. 55, in accordance with an embodiment.

In manufacturing container 12, a die 100 is used to produce perforation region 24. The die 100, shown in FIG. 35, is mechanically pushed down onto the material composing container 12/14 in the area to become perforation region 24. Die 100 comprises a wave-shaped edge 102 that corresponds with the wave shape of perforation region 24 and forms the troughs 28 and waves 30 with edge portion. In addition, indented areas 104/106 are formed in edge 102 to form the perforation tabs 32, 34, respectively.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A multi-compartment tray, comprising:

a. first and second compartments conjoined along a first longitudinal axis and each of which contains an edge that extends along the first longitudinal axis and in a first plane;

b. a perforation region that conjoins the first and second compartments and comprises:

i. a plurality of first and second cut-away regions formed in the edges of the first and second compartments, respectively, wherein each first cut-away region is laterally spaced from every other first cut-away region along the first longitudinal axis, further wherein each second cut-away region is laterally spaced from every other second cut-away region along the first longitudinal axis, additionally wherein each of the plurality of first and second cut-away regions includes a perforation wave having a wave thickness;

ii. a first plurality of perforation tabs joining the first and second compartments and extending in series along a second longitudinal axis that is parallel to and vertically offset from the first longitudinal axis, wherein each of the first plurality of perforation tabs has a first tab thickness, and wherein the first tab thickness is less than the wave thickness; and iii. a second plurality of perforation tabs joining the first and second compartments and extending in series along a third longitudinal axis that is parallel to and vertically offset from the first and second longitudinal axes, whereby the first and second plurality of perforation tabs provide enhanced rigidity to the multi-compartment tray and rotationally bending the first and second compartments relative to one another about the first longitudinal axis causes them to snap and break the first and second plurality of perforation tabs forming the connection between the first and second compartments, wherein each of the second plurality of perforation tabs has a second tab thickness, and wherein the second tab thickness is less than the wave thickness;

wherein the perforation region is substantially sinusoidal and comprises a series of undulating crests and troughs to facilitate separating the first compartment from the second compartment by snapping and breaking the first plurality of perforation tabs and the second plurality of perforation tabs, wherein the perforation tabs are only arranged at the crests and troughs of the perforation region, wherein only one perforation tab is arranged at each of the crests or troughs such that the sole attachment between the first and second compartments is achieved through connection of the perforation tabs at the crests and troughs, and wherein the first and second cut-away regions are longitudinally aligned along the first longitudinal axis.

2. The multi-compartment tray according to claim 1, wherein said first and second compartments are shaped as a polygon.

3. The multi-compartment tray according to claim 2, wherein said first and second compartments are rectangular in shape.

4. The multi-compartment tray according to claim 2, wherein said first and second compartments are semicircular in shape.

5. The multi-compartment tray according to claim 1, wherein there are at least four sets of first and second cut-away regions formed in the edges of the first and second compartments.

6. The multi-compartment tray according to claim 1, wherein there are at least five sets of first and second cut-away regions formed in the edges of the first and second compartments.

7. A multi-compartment tray, comprising:

a. first and second compartments having first and second edges, respectively, that extend towards one another in a first plane;

b. a wave-shaped perforation region arranged about a first longitudinal axis having a series of undulating crests and troughs that extend in series with respective tangents that extend in second and third planes, respectively, and are parallel to and laterally offset from the first plane and from each other, wherein at least some of the undulating crests and troughs comprise a perforation tab formed thereon that connect the first and second compartments, wherein the perforation tabs are only arranged at the crests and troughs of the perforation region, wherein only one perforation tab is arranged at each of the crests or troughs such that the sole attachment between the first and second compartments is achieved through connection of the perforation tabs at the crests and troughs, whereby rotationally bending the first and second compartments relative to one another about the first longitudinal axis causes them to snap and break the perforation tab forming a connection between the first and second compartments, wherein the wave-shaped perforation region has a wave thickness, and each of the perforation tabs has a tab thickness less than the wave thickness;

wherein the perforation region is substantially sinusoidal to facilitate separating the first compartment from the second compartment by snapping and breaking each of the perforation tabs, and wherein the series of undulating crests and troughs is longitudinally aligned along the first longitudinal axis.

8. The multi-compartment tray according to claim 7, wherein said first and second compartments are shaped as a polygon.

9. The multi-compartment tray according to claim 8, wherein said first and second compartments are rectangular in shape.

10. The multi-compartment tray according to claim 8, wherein said first and second compartments are semicircular in shape.

11. The multi-compartment tray according to claim 7, wherein there are at least four sets of undulating crests and troughs.

12. The multi-compartment tray according to claim 7, wherein there are at least five sets of undulating crests and troughs.

13. The multi-compartment tray of claim 1, wherein each of the first plurality of perforation tabs are arranged at one or more crests of the perforation region, and wherein each of the second plurality of perforation tabs are arranged at one or more troughs of the perforation region.

* * * * *